US008134123B2

(12) United States Patent
Nishiguchi et al.

(10) Patent No.: US 8,134,123 B2
(45) Date of Patent: Mar. 13, 2012

(54) MASS SPECTROMETER

(75) Inventors: Masaru Nishiguchi, Kyoto (JP); Yoshihiro Ueno, Uji (JP); Daisuke Okumura, Kyoto (JP); Hiroto Itoi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 202 days.

(21) Appl. No.: 12/594,450

(22) PCT Filed: Jan. 17, 2008

(86) PCT No.: PCT/JP2008/000043
§ 371 (c)(1),
(2), (4) Date: Oct. 2, 2009

(87) PCT Pub. No.: WO2008/129751
PCT Pub. Date: Oct. 30, 2008

(65) Prior Publication Data

US 2010/0116979 A1 May 13, 2010

(30) Foreign Application Priority Data

Apr. 17, 2007 (JP) ..... WOX/JP2007/000417

(51) Int. Cl.
*H01J 49/42* (2006.01)

(52) U.S. Cl. ..... 250/292; 250/281

(58) Field of Classification Search ..... 250/281–282, 250/290–293
See application file for complete search history.

(56) References Cited

U.S. PATENT DOCUMENTS 6,462,338 B1 * 10/2002 Inatsugu et al. ..... 250/292
2003/0222213 A1 12/2003 Taniguchi
2004/0041090 A1 * 3/2004 Bloomfield et al. ..... 250/282
2005/0242281 A1 11/2005 Li
2006/0192104 A1 * 8/2006 Schultz et al. ..... 250/287

FOREIGN PATENT DOCUMENTS

EP 1 592 042 A2 11/2005
JP 08-007827 A 1/1996

(Continued)

OTHER PUBLICATIONS

Written Opinion of the International Searching Authority dated Apr. 8, 2008, issued in corresponding International application No. PCT/JP2008/000043.

(Continued)

*Primary Examiner* — Jack Berman
*Assistant Examiner* — David E Smith
(74) *Attorney, Agent, or Firm* — Sughrue Mion, PLLC

(57) ABSTRACT

One virtual rod electrode is composed by a plurality of electrode plane plates arranged in the ion optical axis direction, and four virtual rod electrodes are arranged around the ion optical axis to form a virtual quadrupole rod type ion transport optical system (30). In one virtual rod electrode, the interval between the adjacent electrode plane plates is set to be large in the anterior area (30A) and small in the posterior area (30B). As the interval between electrodes becomes larger, high-order multipole field components increase and therefore the ion acceptance is increased, which enables an efficient acceptance of ions coming from the previous stage. On the other hand, if the interval between electrodes is small, the quadrupole field components relatively increase and the ion beam's convergence is improved. Therefore, ions can be effectively introduced into a quadrupole mass filter for example in the subsequent stage, which contributes to the enhancement of the mass analysis' sensitivity and accuracy.

24 Claims, 8 Drawing Sheets

FOREIGN PATENT DOCUMENTS

| | | | | |
|---|---|---|---|---|
| JP | 2000-149865 | A | | 5/2000 |
| JP | 2001-101992 | A | | 4/2001 |
| JP | 2001-351563 | A | | 12/2001 |
| JP | 2001351563 | A | * | 12/2001 |
| JP | 2004-014177 | A | | 1/2004 |
| JP | 2005-317529 | A | | 11/2005 |

OTHER PUBLICATIONS

Japanese Office Action dated Mar. 15, 2011, issued in corresponding Japanese Patent Application No. 2009-510747.

English translation of Japanese Patent Publication No. 2001-351563 A, Dec. 21, 2005.

* cited by examiner

MASS SPECTROMETER

TECHNICAL FIELD

The present invention relates to a mass spectrometer used in a liquid chromatograph mass spectrometer, gas chromatograph mass spectrometer, and other mass spectrometers. More precisely, it relates to an ion transport optical system for transporting an ion or ions into the subsequent stage in a mass spectrometer.

BACKGROUND ART

In a mass spectrometer, an ion transport optical system, which is called an ion lens or ion guide, is used to converge ions sent from the previous stage, and in some cases accelerate them, in order to send them to a mass analyzer such as a quadrupole mass filter in the subsequent stage. One type of such ion transport optical system conventionally used is a multipole rod type, such as a quadrupole or octapole system. In a quadrupole mass filter which is often used as a mass analyzer for separating ions in accordance with their mass-to-charge ratio, a pre-filter (which is also called pre-rods) composed of short quadrupole rod electrodes is provided in some cases in the previous stage of the main body of the quadrupole rod electrode in order to smoothly introduce ions into the main body. Such a pre-filter can also be regarded as one kind of an ion transport optical system.

FIG. 15(*a*) is a schematic perspective view of a general quadrupole rod type ion guide 710, and FIG. 15(*b*) is a plane view of the ion guide in a plane orthogonal to the ion optical axis C. The ion guide 710 is composed of mutually parallel four columnar (or tube-like) rod electrodes 711 through 714 which are arranged in such a manner as to surround the ion optical path C. Generally, as illustrated in FIG. 15(*b*), the same radio-frequency voltage $V \cdot \cos \omega t$ is applied to two rod electrodes 711 and 713 facing across the ion optical axis C, and a radio-frequency voltage $-V \cdot \cos \omega t$ which has the same amplitude and reversed phase as the aforementioned radio-frequency voltage $V \cdot \cos \omega t$ is applied to two rod electrodes 712 and 714 which are placed next to the rod electrodes 711 and 713 in the circumferential direction. The radio-frequency voltages $\pm V \cdot \cos \omega t$ applied as just described form a quadrupole radio-frequency electric field in the space surrounded by the four rod electrodes 711 through 714. In this electric field, ions can be converged into the vicinity of the ion optical axis C and transported into the subsequent stage, while being oscillated.

FIG. 16 is a plane view of an octapole rod type ion guide 720 in a plane orthogonal to the ion optical axis C. In the octapole rod type, eight columnar or tube-like rod electrodes 721 through 728 are arranged at the same angular intervals around the ion optical axis C as if they touch an inscribed circle. The radio-frequency voltages applied to each of the rod electrodes 721 through 728 in this case are also the same as in the case of the quadrupole.

In a quadrupole or multipole (more than four) rod type ion transport optical system as previously described, the shape of the radio-frequency electric field formed in the space surrounded by the rod electrodes differs in accordance with the number of their polar elements. This difference is also accompanied by a change in the ion optical properties such as an ion beam convergence, ion transmission, ion acceptance, and mass selectivity. Generally, a quadrupole which has a small number of poles shows a preferable beam convergence and mass selectivity by a collisional cooling with a neutral molecule; increasing the number of poles deteriorates the beam convergence and mass selectivity deteriorate while improving the ion transmission and ion acceptance.

As just described, in a conventional type ion transport optical system, the ion optical properties differ corresponding to the number of poles. Therefore, the ion transport optical system is generally designed in such a manner that the appropriate number of poles is selected in accordance with the relationship between the atmosphere (e.g. gas pressure) in which it is used and the ion optical elements provided in the previous stage and subsequent stage, and that parameters such as the rod electrode's radius and length are determined under the condition of the number of poles. However, the conventional type ion transport optical system has a disadvantage in that the flexibility of the selection of parameters is little and therefore an ion transport optical system having optimal ion optical properties suitable for the purpose cannot be always used, which may lead to the difficulty in increasing the detection sensitivity and accuracy.

In recent years, a higher sensitivity, higher accuracy, higher throughput, and other better properties in a mass spectrometer have been required in order to deal with the growing diversity and complexity of the kind of substances to be analyzed, the demand for a prompt analysis, and other requests. In order to meet such demands, improvement of the performance is required also for an ion transport optical system. However, in practice, the performance improvement based on a conventional multipole rod type configuration has limitations for the aforementioned reasons.

[Patent Document 1] Japanese Unexamined Patent Application Publication No. 2000-149865

[Patent Document 2] Japanese Unexamined Patent Application Publication No. 2001-351563

DISCLOSURE OF THE INVENTION

Problems to be Solved by the Invention

The present invention has been achieved to solve the aforementioned problems, and the main objective thereof is to provide a mass spectrometer capable of improving the detection sensitivity and analysis accuracy by improving the performance of the ion transport optical system for converging ions coming from the previous stage, accelerating or decelerating them in some cases, and sending them into the subsequent stage.

The applicant of the present invention has proposed an ion transport optical system using a virtual rod electrode as illustrated in FIG. 17 and has put it into practical use as an ion transport optical system also capable of accelerating ions while taking advantage of a multipole rod type ion guide having a relatively good ion convergence (for example, refer to Patent Documents 1, 2, and other documents). In this configuration, the rod electrodes 711 through 714 illustrated in FIG. 15(*a*) are respectively replaced by four virtual rod electrodes 731 through 734 composed of a plurality of (four in the example of this figure: however, the number can be any) tabular electrode plane plates 735 arranged along the direction of the ion optical axis C.

In this virtual multipole rod type ion transport optical system 730, different voltages can be respectively applied to the four (or more) electrode plane plates 735 composing one virtual rod electrode 731 through 734. Therefore, for example, a direct current voltage which increases in a stepwise fashion toward the ion's traveling direction may be applied in such a manner as to be superimposed on the radio-frequency voltage to form a direct current electric field whose action accelerates or, inversely, decelerates ions while they are passing through the space surrounded by the virtual rod electrodes 731 through 734.

Up until now, a sufficient analysis has not been performed for the radio-frequency electric field formed in a virtual multipole rod type ion transport optical system as previously described: it has been simply thought that the radio-frequency electric field thereby formed should be the same as that created by a normal multiple rod type ion transport optical system with the same number of polar elements. On the other hand, the inventors of the present patent application have performed an analysis for the radio-frequency electric field formed in a virtual quadrupole rod type ion transport optical system and have discovered that, unlike a normal quadrupole rod type ion transport system, the virtual quadrupole rod type ion transport optical system creates an electric field in which not only a quadrupole electric field but higher-order multipole field components are abundantly included. Furthermore, the inventors have also discovered that such high-order multipole field components vary corresponding to the electrode plane plates' thickness, the intervals between the electrode plane plates adjacent in the ion optical axis direction, the outer edge shape of the electrode plane plates, and other factors.

As previously described, in a multipole field components, ion optical properties such as an ion beam convergence, ion transmission, ion acceptance, and mass selection property vary corresponding to the number of poles. In a virtual multipole rod type ion transport optical system, a plurality of electrode plane plates compose one virtual rod electrode, and therefore it is easy to change, among the plurality of electrode plane plates, the plate thickness, the intervals between the adjacent element plane plates, and outer edge shape. Accordingly, the inventors of the present patent application have conceived, by appropriately adjusting parameters such as the thickness of an electrode plane plate and the intervals between the adjacent electrode plane plates in the ion optical axis direction and appropriately changing the shape of the outer edge facing the ion optical axis of each electrode plane plate, realizing the different ion optical properties between the ion entrance side and ion exit side, or between the ion entrance and exit sides and their intermediate section for example, and thereby obtaining an optimal or almost optimal performance in accordance with the atmosphere in which the virtual multipole rod type ion transport optical system is disposed and with the components provided in the previous stage and subsequent stage.

Means for Solving the Problems

That is, the first aspect of the present invention achieved to solve the aforementioned problems provides a mass spectrometer including a virtual multipole rod type ion transport optical system in which 2N (where N is an integer equal to or more than two) virtual rod electrodes are placed in such a manner as to surround the ion optical axis, each of the virtual rod electrodes being composed of M (where M is an integer equal to or more than two) electrode plane plates separated from each other in the ion optical axis direction, wherein:

the M electrode plane plates composing one virtual rod electrode are arranged in such a manner that the number of kinds of the interval between electrode plane plates adjacent in the ion optical axis direction is at least more than one.

The second aspect of the present invention achieved to solve the aforementioned problems provides a mass spectrometer including a virtual multipole rod type ion transport optical system in which 2N (where N is an integer equal to or more than two) virtual rod electrodes are placed in such a manner as to surround the ion optical axis, each of the virtual rod electrodes being composed of M (where M is an integer equal to or more than two) electrode plane plates separated from each other in the ion optical axis direction, wherein:

the M electrode plane plates composing one virtual rod electrode include an electrode plane plate having a different plate thickness in the ion optical axis direction.

The third aspect of the present invention achieved to solve the aforementioned problems provides a mass spectrometer including a virtual multipole rod type ion transport optical system in which 2N (where N is an integer equal to or more than two) virtual rod electrodes are placed in such a manner as to surround the ion optical axis, each of the virtual rod electrodes being composed of M (where M is an integer equal to or more than two) electrode plane plates separated from each other in the ion optical axis direction, wherein:

the M electrode plane plates composing one virtual rod electrode include a plurality of kinds of plane plates having a different shape of the outer edge facing the ion optical axis.

Here, the "different shape of the outer edge" includes not only the case where the shapes of the outer edges vary such as a semicircle, rectangle, or polygon, but also the case where the shapes of the outer edges are similar, as in the case of semicircles with a different width or radius of curvature of the outer edge arc.

In the aforementioned virtual multipole rod type ion transport optical system, the same radio-frequency voltage (e.g. $+V\cdot\cos\omega t$) is applied to two virtual rod electrodes facing across the ion optical axis, and radio-frequency voltages with a mutually inverted phase (e.g. one is $+V\cdot\cos\omega t$ and the other is $-V\cdot\cos\omega t$) are applied to two virtual rod electrodes adjacent around the ion optical axis. This forms a radio-frequency electric field in the space surrounded by 2N virtual rod electrodes. However, an appropriate direct current voltage, other than a radio-frequency voltage, can also be superimposed and applied.

Effects of the Invention

According to the aforementioned analysis by the inventors of the present invention, in the case where the plate thickness of the electrode plane plates is the same, as the interval between the adjacent electrode plane plates becomes larger, the quadrupole field components become smaller and the higher-order multipole field components increase. In the case where the intervals between the adjacent electrode plane plates are the same, as the plate thickness of the electrode plane plates becomes thicker, the quadrupole field components increase. The larger the quadrupole field components are, the better the ion beam's convergence is. Therefore it is preferable that the quadrupole field components increase in the region where the ion's convergence is significant, or normally in the region adjacent to the ion exit side for sending ions into the subsequent stage, in an ion transport optical system. On the other hand, the larger the multipole field components whose order is higher than quadrupole are, the better the ion acceptance is. Therefore, it is preferable that high-order multipole field components increase in the region where the ion acceptance is significant, or normally in the region adjacent to the ion injection side for receiving ions coming from the previous stage, in an ion transport optical system.

Given these factors, as a preferable embodiment of the first aspect of the present invention, in the virtual multipole rod type ion transport optical system, the interval between adjacent electrode plane plates may be relatively large in the ion injection side and the interval between adjacent electrode plane plates may be relatively small at the ion exit side.

As a preferable embodiment of the second aspect of the present invention, in the virtual multipole rod type ion transport optical system, a relatively thin electrode plane plate or plates may be placed at the ion injection side and a relatively thick electrode plane plate or plates may be placed at the ion exit side.

With the configuration according to these embodiments, ions coming from the previous stage are effectively taken by a high acceptance into the virtual multipole rod type ion transport optical system, and are sent into the subsequent stage in the state converged in the vicinity of the ion optical axis by a high beam convergence. Therefore, in this virtual multipole rod type ion transport optical system, ions coming from the component in the previous stage are efficiently taken and the ions are efficiently introduced into the subsequent component. Accordingly, more ions than ever before can be mass analyzed and the analysis' high sensitivity and high accuracy can be achieved.

In a liquid chromatograph mass spectrometer for example, a multistage differential pumping system is often used in order to keep the inside of the analysis chamber in a high vacuum state, where a mass separator and ion detector are provided. In such a configuration, an aperture which communicates the chambers with different gas pressure is extremely small. The ion transport optical system having a high ion convergence at the ion exit side as previously described is particularly advantageous in sending ions into the subsequent stage through such an extremely small aperture.

Contrary to the aforementioned embodiment, the interval between adjacent electrode plane plates may be relatively small at the ion injection side and the interval between adjacent electrode plane plates may be relatively large at the ion exit side. Simultaneously or alternatively, a relatively thick electrode plane plate or plates may be placed at the ion entrance side, and a relatively thin electrode plane plate or plates may be placed at the ion exit side. In these cases, ions which are converged in the anterior half section can be sent into the subsequent stage with high passage efficiency. In addition, the interval between adjacent electrode plane plates and the thickness of each electrode plane plate may be changed among the ion injection side, ion exit side, and their intermediate section. With such a configuration, for example, a function of temporarily storing ions in the vicinity of the intermediate portion of the ion transport optical system, i.e. a function similar to an ion trap, can be realized.

Moreover, since changing the shape of the outer edge facing the ion optical axis in each electrode plane plate brings about the same function as realized by changing the electrode plane plates' thickness or adjacent intervals as previously described, also with the mass spectrometer according to the third aspect of the present invention, the same effects as the first and second aspects of the present invention can be accomplished.

As a concrete embodiment of the mass spectrometer according to the third aspect of the present invention, in the virtual multipole rod type ion transport optical system, a relatively narrow electrode plane plate or plates may be placed at the ion injection side and a relatively wide electrode plane plate or plates may be placed at the ion exit side. Alternatively, in the virtual multipole rod type ion transport optical system, the shape of the outer edge facing the ion optical axis may be an arc, an electrode plane plate or plates with an arc whose radius of curvature is relatively small may be placed at the ion injection side and the electrode plane plate or plates with an arc whose radius of curvature is relatively large may be placed at the ion exit side.

The virtual multipole rod type ion transport optical system can be widely used at any portion where ions are required to be transported into the subsequent stage in a mass spectrometer. For example, it may be provided as a pre-filter in the previous stage of the main body of a quadrupole mass filter.

Generally, a quadrupole mass filter is provided in an analysis chamber in a high vacuum state (or low gas pressure). Therefore, with a pre-filter which is provided in this previous stage, the ion beam's convergence by cooling can hardly be expected. Even in such a case, with the aforementioned configuration, ions are converged by the action of the electric field and can be effectively introduced into the main body of the quadrupole mass filter.

The virtual multipole rod type ion transport optical system may be provided in a collision cell supplied with a gas for the collision induced dissociation of ions. With this configuration, a precursor ion or ions mass-selected in a quadrupole mass filter for example in the previous stage are effectively taken to be dissociated by collision induced dissociation, and product ions produced thereby are converged into the vicinity of the ion optical axis and can be effectively introduced into a quadrupole mass filter for example in the subsequent stage.

In the mass spectrometers according to the first through third aspects of the present invention, N can be any integer equal to or more than 2. However, N may be preferably 2 in order to utilize the ion optical properties by quadrupole field components, such as a high ion beam convergence and mass selectivity.

In the mass spectrometers according to the first through third aspects of the present invention, the "M electrode plane plates separated from each other in the ion optical axis direction" need only to be separated from each other in the ion optical axis direction within the range in which they affect the multipole radio-frequency electric field formed in the space around the ion optical axis surrounded by the electrode plane plates, i.e. within a predetermined range from the ion optical axis in the radial direction. In other words, in the area further than the aforementioned range, the M electrode plane plates may be mutually attached or connected. Therefore, one columnar conductive rod may be cut to form M tongue-shaped bodies which correspond to the M electrode plane plates projecting from the circumferential surface of the columnar body. However, in this case, the M virtual electrode plane plates (or tongue-shaped bodies) arranged in the ion optical axis direction are electrically connected to each other. Therefore this configuration is inappropriate for forming different direct current electric fields in the ion optical axis direction.

EXPLANATION OF NUMERALS

1 . . . Nozzle
2 . . . Sampling Cone
3 . . . First Ion Lens
4 . . . Second Ion Lens
5 . . . Analysis Chamber
6 . . . Pre-Filter
7 . . . Quadrupole Mass Filter
8 . . . Ion Detector
10, 20, 30, 40, 50, 70, 80, 90 . . . Q-array
111-14M, 311-34M, 411-44M, 511-54M, 811-843, 911-943 . . . Electrode Plane Plate
30A, 40A, 50A . . . Anterior Half Section
30B, 40B, 50B . . . Posterior Half Section
60 . . . First-Stage Quadrupole Mass Filter
61 . . . Collision Cell
611 . . . Injection Side Aperture
612 . . . Exit Side Aperture
63 . . . Second-Stage Quadrupole Mass Filter
C . . . Ion Optical Axis

BEST MODES FOR CARRYING OUT THE INVENTION

Figure 1A:
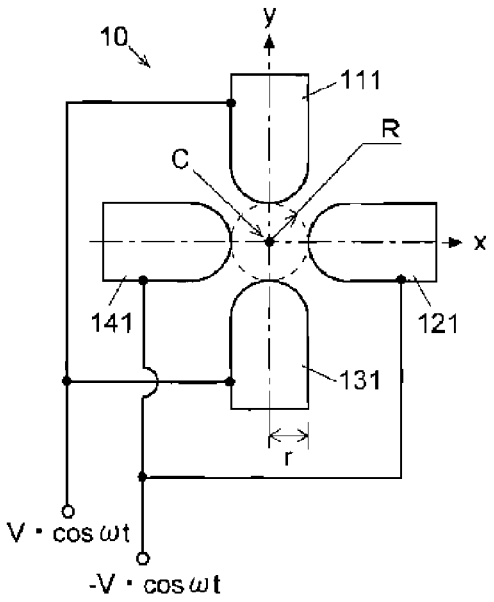
FIG. 1*a* and FIG. 1*b* is a configuration diagram of an example of a virtual quadrupole rod type ion transport optical system.
Figure 1B:
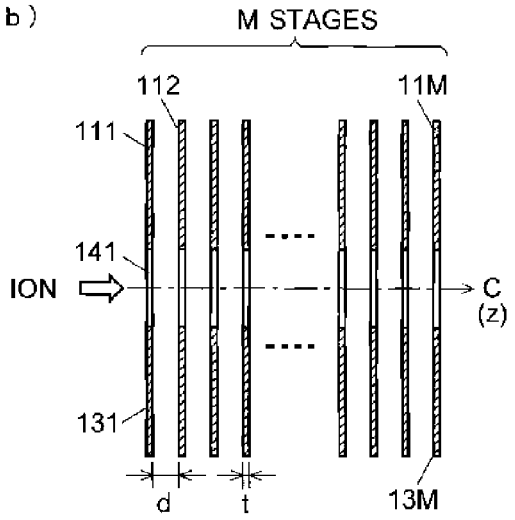

First, the principle of the virtual multipole rod type ion transport optical system in the mass spectrometer according to the present invention will be explained. It is assumed that the ion transport optical system to be hereinafter described has the virtual quadrupole rod configuration illustrated in FIG. 1 (this system will be called a "Q-array"). FIG. 1(*a*) is a schematic plane view of the Q-array 10 in a plane orthogonal to the ion optical axis C, and FIG. 1(*b*) is a schematic sectional view of the Q-array cut along the y-axis FIG. 1(*a*).

M electrode plane plates 111 through 11M aligned in the direction of the ion optical axis C (or z-axis direction) at predetermined intervals of d compose a virtual rod (which will be virtually indicated with the numeral 11 although not shown in the figure), and four virtual rods (11, 12, 13, and 14) are rotation-symmetrically arranged around the ion optical axis C at intervals of 90 degrees to compose a quadrupole. In addition, on an x-axis-y-axis plane orthogonal to the ion optical axis C, four electrode plane plates (111, 121, 131, and 141, for example) rotation-symmetrically arranged at 90 degrees around the intersection point with the ion optical axis C make one stage, and M planes of this stage arranged in the z-axis direction compose M stages. Therefore, this Q-array 10 has 4×M electrode plane plates in total.

All of these electrode plane plates are made of a metal plate (or another conductive member equal to metal) with the plate thickness of t, and have a long shape having the width of 2*r*, with one end shaped like an arc. Each electrode plane plate is arranged so that its arc-shaped portion internally touches a circle centering around the ion optical axis C. This inscribed circle's radius, i.e. the shortest distance from the ion optical axis C to each electrode plane plate, is R.

Figure 8:
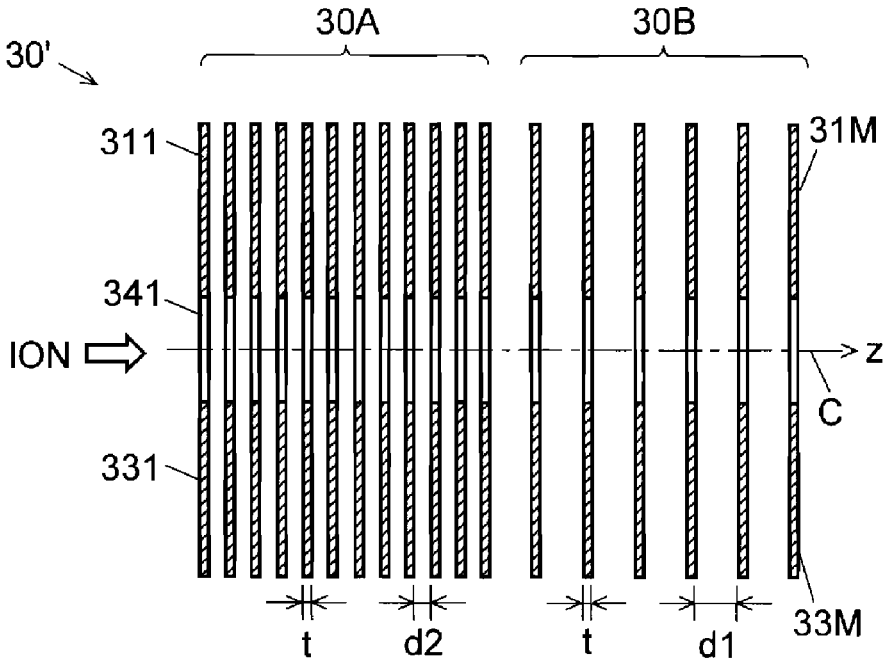
FIG. 8 is a configuration diagram illustrating a modification example of the Q-array illustrated in FIG. 4.

It is known that the potential created by multipole rod electrodes can be generally expressed by the following multipole expansion:

$$\Phi(r,\Theta)=\Sigma(K_n/R^n)r^n\cdot\cos(n\Theta) \quad (1)$$

where Σ is the summation for n, n is a positive integer expressing the order of the multipole field, and $K_n$ is a multipole expansion coefficient. Then, letting the electrode plane plate's width 2*r* and the inscribed circle's radius R be a certain constant value in the configuration illustrated in FIG. 1, multipole expansion coefficients were computed for the cases where the potential was multipole expanded according to the expression (1), while the adjacent electrode plane plates' interval d and the electrode plane plate's thickness t were changed. The calculation result is illustrated in Table 1. In addition, as a reference, computation values of multipole expansion coefficients for the ion transport optical system using a normal type of quadrupole rod electrodes as shown in FIG. 8 are illustrated in Table 2.

TABLE 1

| | K2 | | K6 | | | | | |
|---|---|---|---|---|---|---|---|---|
| | t = | t = | | t = | K10 | | K14 | |
| d | 0.5 | 1.0 | t = 0.5 | 1.0 | t = 0.5 | t = 1.0 | t = 0.5 | t = 1.0 |
| 2 | 0.843 | 0.913 | 0.012 | 0.026 | 0.096 | −0.009 | −0.011 | 0.111 |
| 4 | 0.697 | 0.765 | 0.146 | 0.175 | 0.039 | −0.085 | −0.031 | 0.237 |
| 6 | 0.625 | 0.692 | 0.267 | 0.314 | −0.123 | −0.273 | 0.142 | 0.439 |
| 8 | 0.593 | 0.660 | 0.327 | 0.381 | −0.208 | −0.370 | 0.234 | 0.554 |

TABLE 2

| $K_2$ | $K_6$ | $K_{10}$ | $K_{14}$ |
|---|---|---|---|
| 0.994 | 0.012 | −0.002 | 0.003 |

Where $K_n$ is a coefficient corresponding to the components of the 2n-pole field. Accordingly, for example, $K_2$ is the expansion coefficient of the components of the quadrupole field, and $K_6$ is the expansion coefficient of the components of the dodecapole field. $K_2$, $K_6$, $K_{10}$, and $K_{14}$ were selected because these expansion coefficients show a significant value which cannot be considered as zero. As can be understood by comparing Table 1 with Table 2, Q-array has larger values for high-order multipole expansion coefficients compared to a general quadrupole rod type. This signifies that a radio-frequency field formed by a Q-array has not only quadrupole field components, but many high-order multipole field components, even if it has a quadrupole configuration as shown in FIG. 1. Furthermore, it is understood that, given the same thickness t of the electrode plane plate, the quadrupole expansion coefficient $K_2$ decreases as the adjacent electrode plane plates' interval d increases, and instead high-order multipole expansion coefficients $K_6$, $K_{10}$, and $K_{14}$ increase. Simultaneously, it is understood that, even if the adjacent electrode plane plates' interval d is the same, the expansion coefficients clearly change as the electrode plane plate's thickness t changes.

The expansion coefficients also change when some other parameters such as the electrode plane plate's width 2*r* and the inscribed circle's radius R are changed. The expansion coefficients' change due to such a parameters' change is minor compared to the degree of the expansion coefficient's change resulting from the change of the electrode plane plate's thickness t or adjacent electrode plane plates' interval d. However, it can be used together with the electrode plane plate's thickness t and adjacent electrode plane plates' interval d, or it can be singularly used.

As previously described, a Q-array includes many high-order multipole field components compared to a normal quadrupole rod type ion transport optical system. What is more, the amount of high-order field components can be adjusted by changing the parameters such as the electrode plane plate's thickness t or adjacent electrode plane plates' interval d. The quadrupole field components whose number of poles is small are superior in the ion beam's convergence and mass selectivity to higher-order multipole field components. And, high-order multipole field components are superior in the beam acceptance, ion transmission, and other properties to the quadrupole field components, in spite of being inferior in the ion beam's convergence and mass selectivity. In a Q-array, parameters can be changed in one virtual rod, such as the intervals, thickness, and width of the M electrode plane plates which compose the virtual rod. Therefore, by varying these parameters (i.e. making them nonconstant) in the ion optical axis C direction, in accordance for example with the kind of ion optical elements provided in the previous and subsequent stages and an atmosphere condition (e.g. gas pressure) in which this Q-array is provided, desired ions can be more preferably sent into the subsequent stage.

Figure 2:
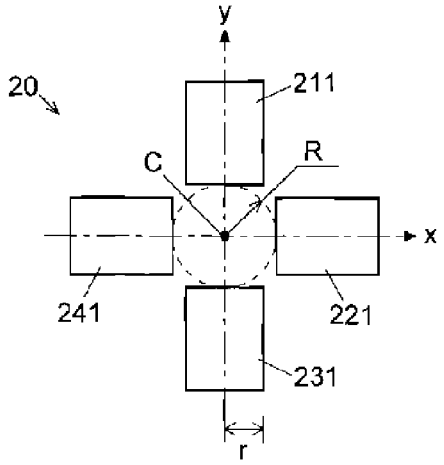
FIG. 2 is a configuration diagram of another example of a virtual quadrupole rod type ion transport optical system.

As illustrated in FIG. 2 which corresponds to FIG. 1(*a*), also in the case where the shape of the electrode plane plates can be simply a rectangle (e.g. 211 through 241) whose one end is not a semicircle, by differentiating the electrode plane plate's thickness t and adjacent electrode plane plates' interval d, the magnitude of multipole field components can be adjusted in order to further preferably send ions into the subsequent stage. In addition, the shape of the outer edge of an electrode plane plate facing the ion optical axis C may be appropriately changed along the ion optical axis C, such as a semicircle, rectangle, or steeple, to change the magnitude of the multipole field components. Since in a Q-array it is also easy to change the shape of the outer edge for each of the M electrode plane plates composing one virtual rod, the shape of the outer edge of the electrode plane plates may be changed rather than changing the electrode plane plate's thickness t or adjacent electrode plane plates' interval d.

EMBODIMENTS

Figure 3:
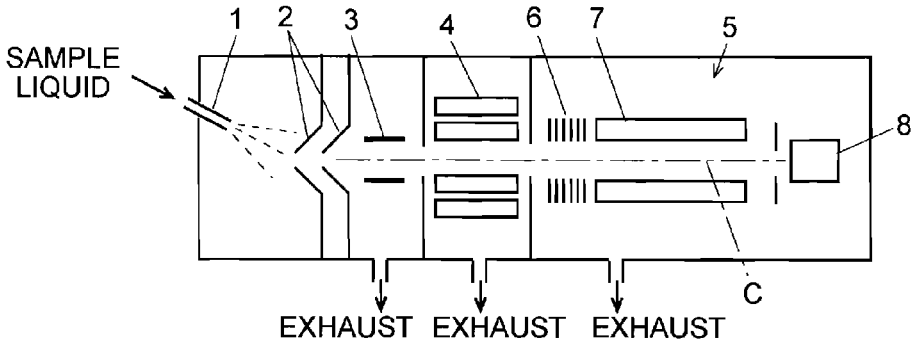
FIG. 3 is a configuration diagram of the main portion of a mass spectrometer of an embodiment according to the present invention.

Next, a mass spectrometer which is an embodiment of the mass spectrometer according to the present invention will be described with reference to the figures. FIG. 3 is a configuration diagram of the main portion of the mass spectrometer of the present embodiment.

This mass spectrometer is an atmospheric pressure ionization mass spectrometer in which an electrospray ion source is used as an ion source. A liquid chromatograph is provided in the previous stage, and a sample liquid whose components have been separated in the column of the liquid chromatograph is introduced into a nozzle 1. The sample liquid is supplied with biased charges from the nozzle 1 and eventually atomized (or electro sprayed) into a space at substantially atmospheric pressure. When the solvent contained in the droplets of the sprayed liquid vaporizes, a variety of components included in the sample are ionized and sent into the subsequent stage through a sampling cone 2. These ions are converged, and accelerated in some cases, while passing through the first ion lens 3 and the second ion lens 4 to be introduced into an analysis chamber 5 in which a high vacuum atmosphere is maintained.

In this analysis chamber 5, a quadrupole mass filter 7 is provided which is composed of four rod electrodes for selectively allowing an ion having a specific mass (mass-to-charge ratio m/z, to be exact) to pass through. A pre-filter 6 is provided immediately before the quadrupole mass filter 7, so that ions are effectively introduced into the space surrounded by the four rod electrodes of the quadrupole mass filter 7. The ions which have passed through the quadrupole mass filter 7 are introduced into an ion detector 8, which produces a detection signal in accordance with the amount of the received ions.

A conventionally used pre-filter consists of a quadrupole system composed of rod electrodes (which are called pre-rods) shorter than the rod electrodes of the quadrupole mass filter 7. However, in the mass spectrometer according to the present embodiment, a Q-array based on the aforementioned principle is used as the pre-filter 6.

Figure 4:
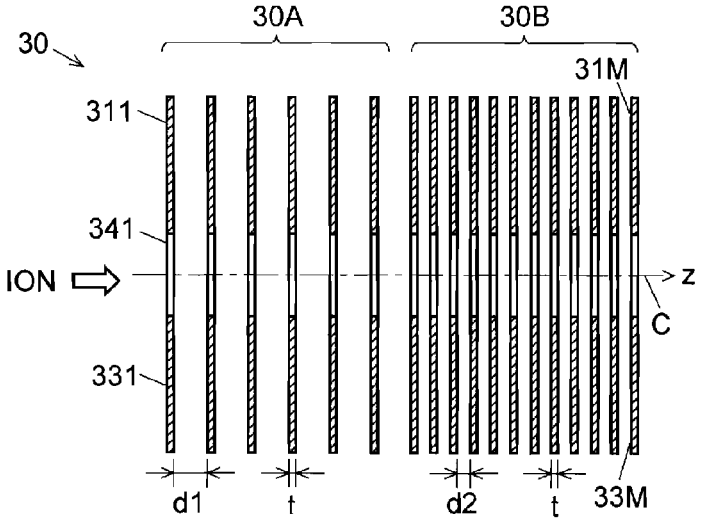
FIG. 4 is a configuration diagram illustrating an example of a Q-array used as the pre-filter in FIG. 3.

FIG. 4 is a diagram illustrating an example of a Q-array used as the pre-filter 6. This Q-array 30 has the same arrangement of the electrode plane plates (e.g. 311 through 341) in the x-axis-y-axis plane orthogonal to the ion optical axis C as FIG. 1(*a*). Also, the shape of all electrode plane plates (i.e. electrode's width 2*r*) and thickness t is the same as illustrated in FIG. 1. Therefore, for all the electrode plane plates, the electrode's width 2*r* and thickness t are the same. On the other hand, the interval of the adjacent electrode plane plates in the ion optical axis C direction is not constant but composes the two following sections: the anterior half section 30A in which the interval is d1 and the posterior half section 30B in which the interval is d2 which is narrower than d1. That is, in one virtual rod electrode, two different intervals d1 and d2 of the adjacent electrode plane plates exist.

As previously described, with large intervals between adjacent electrodes, high-order multipole field components are increased compared to the case of small intervals and accordingly the ion's acceptance is increased. In the mass spectrometer according to the present embodiment, ions sent into the analysis chamber 5 from the intermediate vacuum chamber which is provided in the previous stage of the analysis chamber 5 travel while spreading in an approximately conic shape. However, by maintaining a high level of ion acceptance within the anterior half section 30A of the Q-array 30, ions can be effectively received. Since the ion's transmission is improved with larger high-order multipole field components, the ions which have been effectively received can be efficiently sent into the posterior half section 30B.

On the other hand, in the posterior half section 30B of the Q-array 30, the interval between the adjacent electrodes is narrower than that of the anterior half section 30A, and the quadrupole field components is relatively large. Therefore, the ion's convergence is improved and the ion stream tends to converge around the ion optical axis C. That is, in the configuration illustrated in FIG. 4, ions which have been sent from the previous stage can be effectively taken by a high acceptance into the space surrounded by four virtual rods, and the ion beam's spread can be narrowed while ions are traveling, so that they can be delivered to be effectively injected into the quadrupole mass filter 7 in the next stage. Accordingly, a larger amount of target ions can be injected into the quadrupole mass filter 7 compared to the case where a simple quadrupole pre-rod is used as before. Consequently, the amount of ions which are selected in the quadrupole mass filter 7 and reach the ion detector 8 is also increased, which improves the mass analysis' sensitivity and accuracy.

Figure 5:
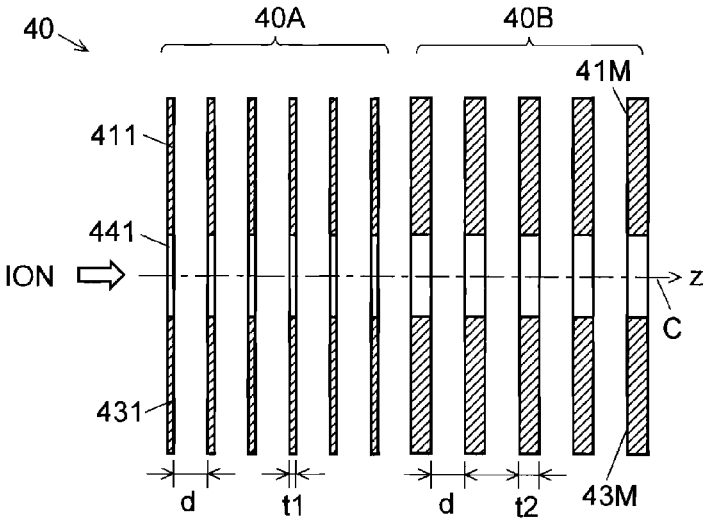
FIG. 5 is a configuration diagram illustrating another example of a Q-array used as the pre-filter in FIG. 3.

FIG. 5 is a diagram illustrating another example of a Q-array used as the pre-filter 6. In this Q-array 40, one virtual rod electrode includes two kinds of electrode plane plates' thickness of t1 and t2, while the adjacent electrode plane plate's interval d is constant. That is, in the anterior half section 40A, the electrode plane plates have a smaller thickness of t1, and in the posterior half section 40B, the electrode plane plate's thickness is t2 which is larger than t1.

As is understood from the previously illustrated Table 1, using thicker electrode plane plates increases the quadrupole field components and accordingly improves the ions' convergence than using thinner plates. Therefore, when ions which have been injected into the Q-array 40 enter the posterior half section 40B, the ions tend to converge around the ion optical axis C. Accordingly, a larger amount of target ions can be injected into the quadrupole mass filter 7 compared to the case where a simple quadrupole pre-rod is used as before. This improves the mass analysis' sensitivity and accuracy.

Figure 6A:
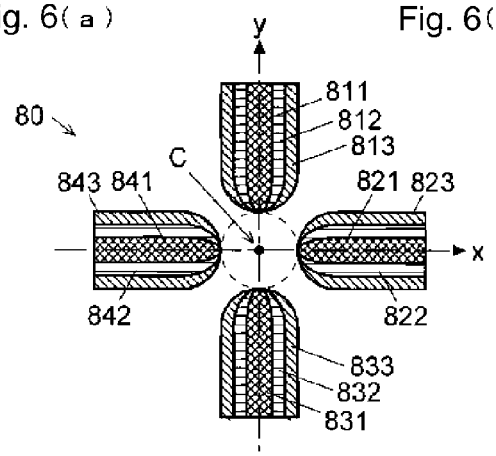
FIG. 6*a* and FIG. 6*b* is a configuration diagram illustrating another example of a Q-array used as the pre-filter in FIG. 3.
Figure 6B:
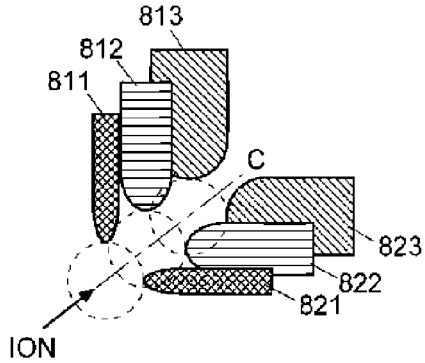

FIG. 6 is a diagram illustrating still another example of a Q-array used as the pre-filter 6. In this Q-array 80, although the interval between the adjacent electrode plain plates and the thickness of each electrode plain plate are constant in one virtual rod electrode, the width of each electrode plain plate, i.e. the shape of the outer edge facing the ion optical axis C in a broad sense, is different. That is, the width of the four electrode plain plates 811, 821, 831 and 841 at the ion injection side is the narrowest, and the electrode plain plates' width gets broader toward the ion exit side. This brings about the same effect as the configurations of FIGS. 4 and 5. In this example, since the shape of the outer edge facing the ion optical axis C is a semicircle, the width difference is identical to the difference of the radius of curvature of the semicircle's arc.

Figure 7A:
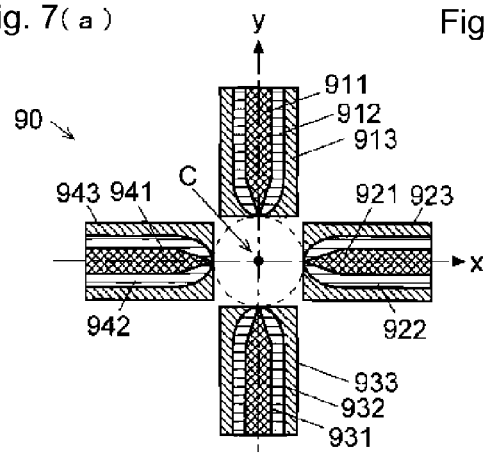
FIG. 7*a* and FIG. 7*b* is a configuration diagram illustrating another example of a Q-array used as the pre-filter in FIG. 3.
Figure 7B:
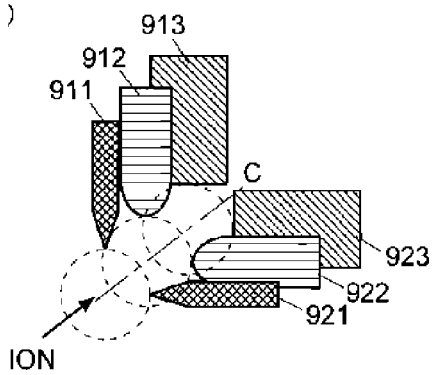

FIG. 7 is a diagram illustrating yet another example of a Q-array used as the pre-filter 6. In this Q-array 90, although the interval between the adjacent electrode plain plates and the thickness of each electrode plain plate are constant in one virtual rod electrode, the shape of the outer edge facing the ion optical axis C is different among the electrode plain plates. That is, the shape of the outer edge of the four electrode plain plates 911, 921, 931 and 941 at the ion injection side is a steeple, the shape of the outer edge of the four electrode plain plates 912, 922, 932 and 942, which are in the rear of the plates 911 921, 931 and 941, is a semicircle, and the shape of the outer edge of the four electrode plain plates 913, 923, 933 and 943 at the ion exit side is rectangular. This brings about the same effect as the configurations of FIGS. 4 through 6.

The Q-arrays having the aforementioned configurations of FIGS. 4 through 7 place a significance on the ions' convergence particularly at the ion exit side. These are especially useful for an atmospheric pressure ionization mass spectrometer having a configuration of a multistage differential pumping system as illustrated in FIG. 3, because in the configuration of such a multistage differential pumping system, the apertures formed on the walls partitioning the adjacent vacuum chambers are so tiny that it is necessary to converge the ions as close to the ion optical axis C as possible in order to improve the passage efficiency of the ions through the apertures. In the meantime, in the case where ions sent from this Q-array are accepted in a relatively large area, the ions' convergence at the ion exit side is not very significant: rather than that, a greater significance may be put on the ions' transmission to improve the entire ion transport efficiency.

Figure 10:
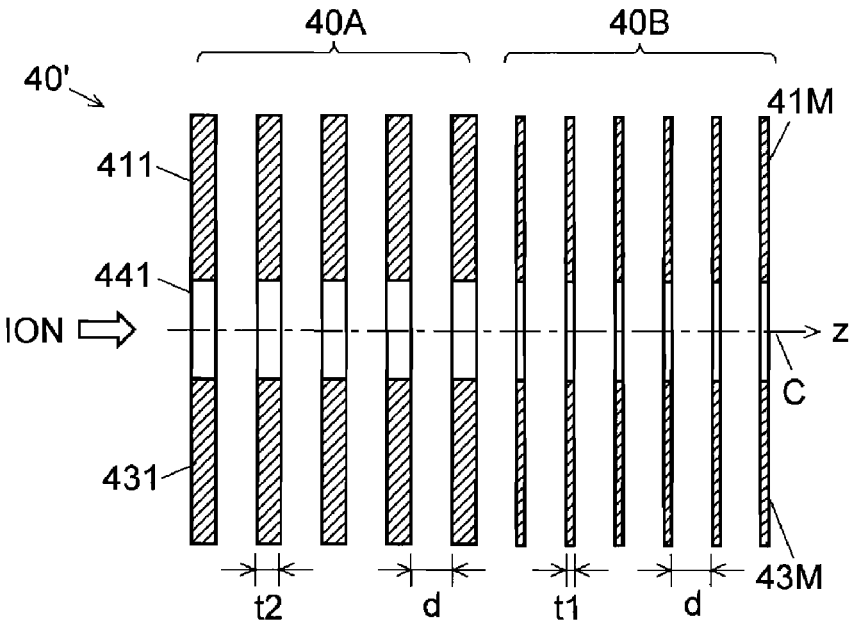
FIG. 10 is a configuration diagram illustrating a modification example of the Q-array illustrated in FIG. 5.

For such a purpose, the configurations of Q-arrays 30' and 40' illustrated in FIGS. 8 and 10 for example may be preferable. In the Q-array 30' illustrated in FIG. 8, contrary to the Q-array 30 illustrated in FIG. 4, the intervals between the electrode plane plates adjacent in the ion optical axis C direction in the anterior half section 30A are set to be d2 and the intervals in the posterior half section 30B are set to be d1 which is wider than d2. That is, also in this case, one virtual rod electrode includes two different kinds of interval of adjacent electrode plane plates, i.e. d1 and d2. In the Q-array 40' illustrated in FIG. 10, contrary to the Q-array 40 illustrated in FIG. 5, the thickness of each electrode plane plate in the anterior half section 40A is set to be t2 and the thickness of each electrode plane plate in the posterior half section 40B is set to be t1 which is larger than t2. That is, also in this case, one virtual rod electrode includes the electrode plane plates whose plate thickness is different.

With the configurations of the Q-arrays 30' and 40', the ions' acceptance is relatively narrow in the anterior half sections 30A and 40A. However, this is not disadvantageous if the injected ions are already converged in the vicinity of the ion optical axis C. After reaching the posterior half section 30B or 40B, the ions can be sent into the subsequent stage with relatively high transmission.

Figure 9:
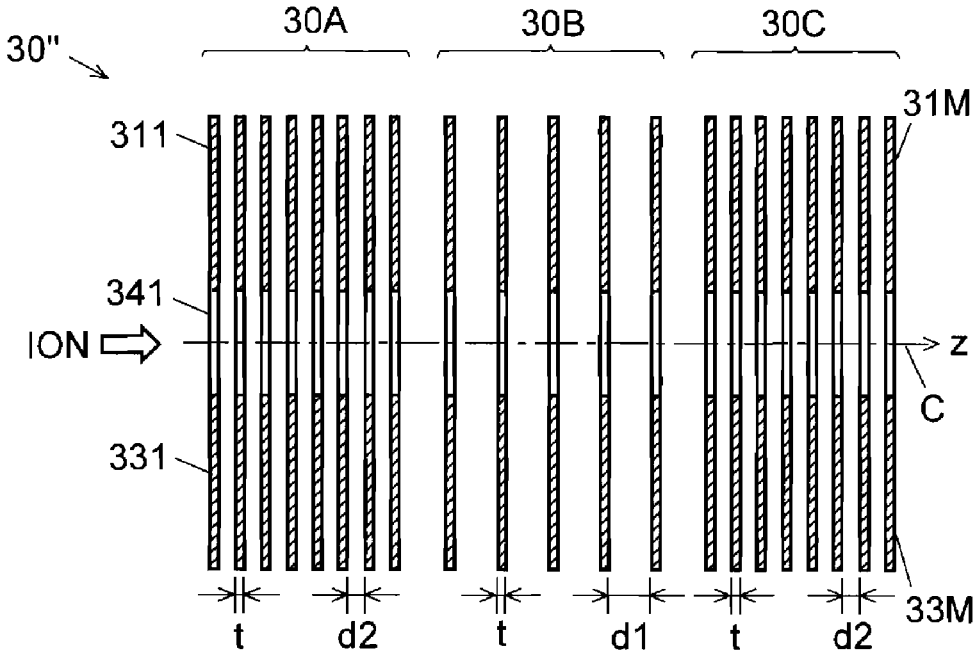
FIG. 9 is a configuration diagram illustrating a modification example of the Q-array illustrated in FIG. 4.

Not only changing the interval between the adjacent electrode plane plates and the thickness of the electrode plane plates simply between the anterior half section and posterior half section, but a more complex combination may be taken to add another function to a Q-array. The Q-array 30" illustrated in FIG. 9 is divided in the ion optical axis C direction into an anterior section 30A, intermediate section 30C, and posterior section 30B. The interval between adjacent electrode plane plates is set to be relatively narrow d2 in the anterior section 30A at the ion injection side and in the posterior section 30B at the ion exit side, and in the intermediate section 30C, the interval between adjacent electrode plane plates is set to be relatively wide d1. With such a configuration, since the ion acceptance in the intermediate section 30C is relatively large, ions that have been injected are easy to be temporarily stored in this intermediate section 30C. Therefore, ions produced in a certain time range can be temporarily stored in this Q-array 30", and subsequently the stored ions can be collectively introduced into an ion trap or other components.

Figure 11:
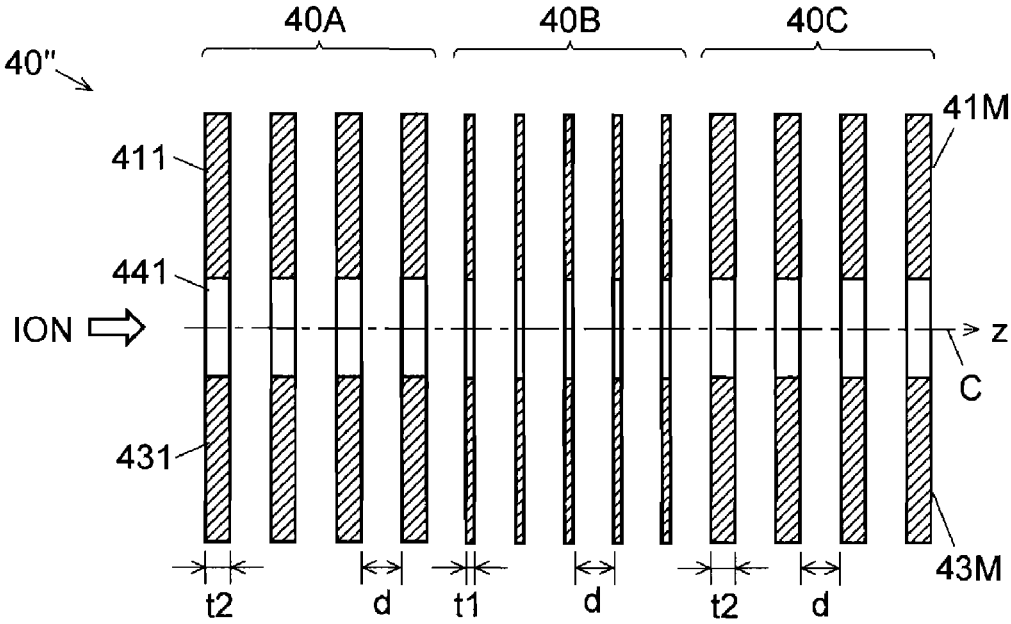
FIG. 11 is a configuration diagram illustrating a modification example of the Q-array illustrated in FIG. 5.

In order to fulfill the same function as this, the configuration of the Q-array 40" illustrated in FIG. 11 may be adopted. That is, in the Q-array 40" illustrated in FIG. 11, the electrode plane plates have a relatively large thickness of t2 in the anterior section 40A at the ion injection side and in the posterior section 40B at the ion exit side, whereas, in the intermediate section 40C, the electrode plane plates have a relatively small thickness of t1.

Figure 12A:
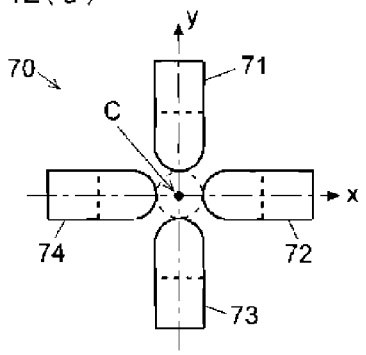
FIG. 12*a* and FIG. 12*b* is a configuration diagram illustrating another example of the Q-array used as the pre-filter in FIG. 3.
Figure 12B:
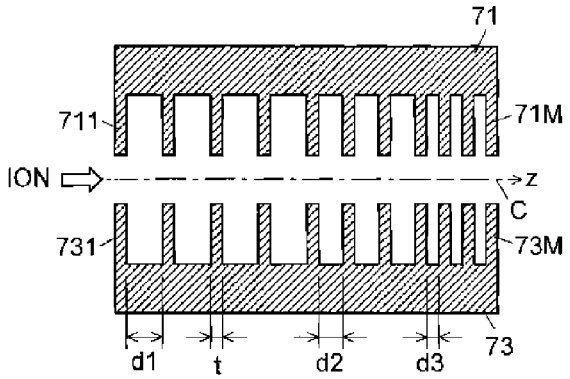

In each of the Q-arrays 30, 30', 30", 40, 40', 40", 80, and 90 of the various aforementioned embodiments, a plurality of electrode plane plates composing one virtual rod electrode are completely separated in the direction of the ion optical axis C. However, since the effect thereof is achieved by the change of potential by a multipole radio-frequency electric field, the plurality of electrode plane plates may be connected at such portions that do not substantially affect the formation of the multipole radio-frequency electric field. As one of its examples, the Q-array 70 having the configuration illustrated in FIG. 12 can be adopted. FIG. 12(*a*) is a schematic plane view of the Q-array 70 in a plane orthogonal to the ion optical axis C, and FIG. 12(*b*) is a schematic sectional view of the array cut along the y-axis in FIG. 12(*a*).

One columnar metal (or other conductive material) rod is cut to form an electrode block (e.g. 71) including M tongue-shaped bodies (e.g. 711 through 71M) having an interspace therebetween and adjacent in the ion optical C direction. Four electrode blocks 71 through 74 are arranged around the ion optical axis C to form the Q-array 70. M tongue-shaped bodies 711 through 71M substantially function as electrode plane plates, and with regard to a multipole radio-frequency electric field, those bodies can produce almost the same state as can be created by a structure in which the electrode plane plates are completely separated as FIG. 4 or the like. However, in this structure, since M tongue-shaped bodies arranged in the ion optical axis C direction have the same electric potential, it is not possible to apply different direct current voltages to the electrode plane plates adjacent in the ion optical axis C direction so as to realize a direct current-like potential gradient.

In the aforementioned embodiments, a Q-array which is characteristic of the present invention is used as the pre-filter 6 of the quadrupole mass filter 7. However, it is evident that the Q-array can be used for another ion transport optical system having a function of converging and transporting ions.

Figure 13:
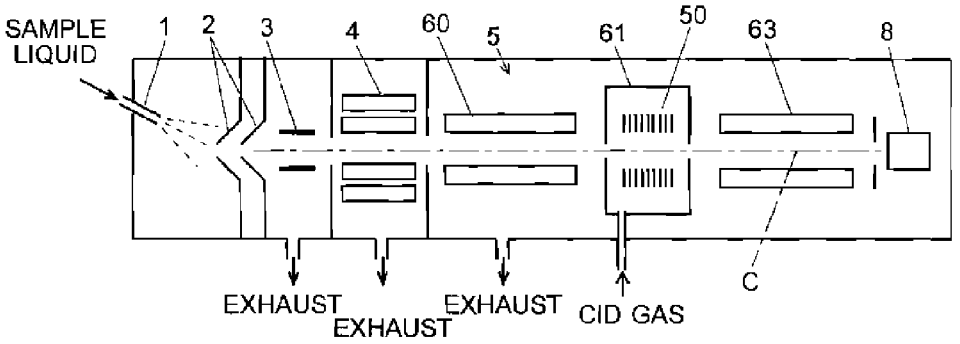
FIG. 13 is a configuration diagram illustrating the main portion of an MS/MS mass spectrometer according to another embodiment of the present invention.

FIG. 13 is a schematic configuration diagram of an MS/MS mass spectrometer which is another embodiment of the present invention. In FIG. 13, the same components as illustrated in FIG. 1 are indicated with the same numerals and the explanations are omitted. This mass spectrometer includes a first-stage quadrupole mass filter 60, collision cell 61 and second-stage quadrupole mass filter 63, which are arranged in the order of the ions' progression inside the analysis chamber 5. The collision cell 61 contains one of the previously described Q-arrays. In the analysis chamber 5, although ions having a variety of masses are introduced into the first-stage quadrupole mass filter 60, only a target ion (or precursor ion) having a specific mass (mass-to-charge ratio m/z, to be exact) selectively passes the first-stage quadrupole mass filter 60 to be sent into the collision cell 61 in the subsequent stage, while other ions are dispersed along the way.

A predetermined collision-induced dissociation (CID) gas such as Ar gas is introduced into the collision cell 61. While passing through the electric field formed by the Q-array 50 provided inside the collision cell 61, the target ion is dissociated if it collides with the CID gas, so that a variety of product ions are produced. Such a variety of product ions and the target ions that have not been dissociated exit from the collision cell 61 and are introduced into the second-stage quadrupole mass filter 63. Only product ions having a specific mass selectively pass through the second-stage quadrupole mass filter 63 and are sent into the detector 8, while other ions are dispersed along the way.

As just described, only the product ions having a specific mass reach the ion detector 8, which produces the detection signal in accordance with the amount of these ions. By varying the voltage applied to the second-stage quadrupole mass filter 63, the mass of the product ion selected in this quadrupole mass filter 63 can be scanned. In addition, by changing the voltage applied to the first-stage quadrupole mass filter 60, the mass of the ion, i.e. precursor ion, selected in the quadrupole mass filter 60 can be changed.

Figure 14:
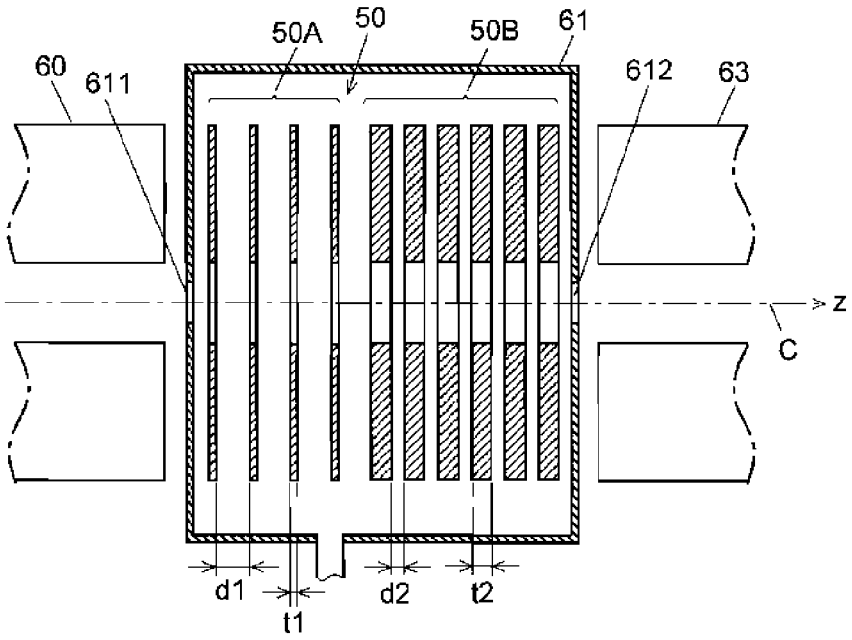
FIG. 14 is a configuration diagram illustrating an example of the Q-array provided in the collision cell in FIG. 13.
Figure 15A:
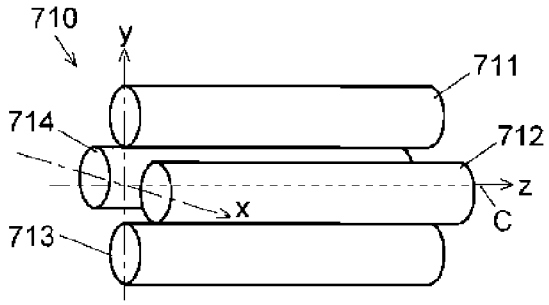
Fig. 15(a) Prior Art
FIG. 15*a* and FIG. 15*b* is a schematic configuration diagram of a conventional and general quadrupole rod type ion guide.
Figure 15B:
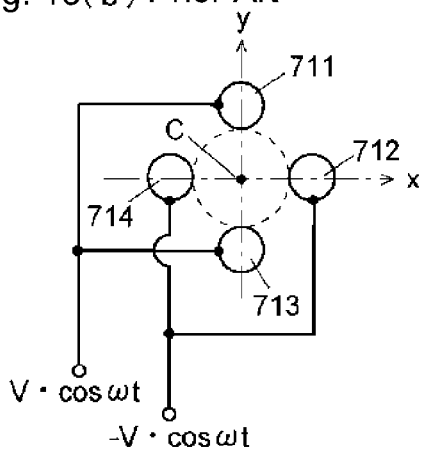
Fig. 15(b) Prior Art
Figure 16:
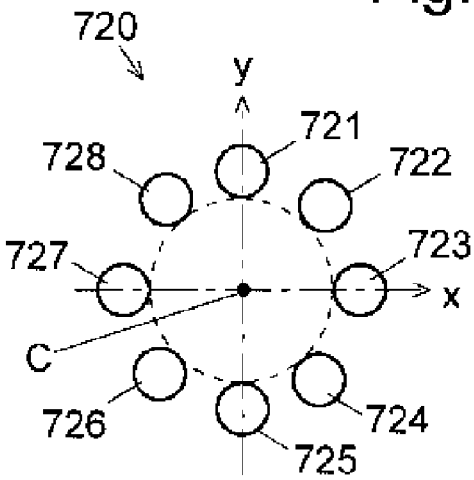
Fig. 16 Prior Art
FIG. 16 is a schematic configuration diagram of a conventional and general octapole rod type ion guide.
Figure 17:
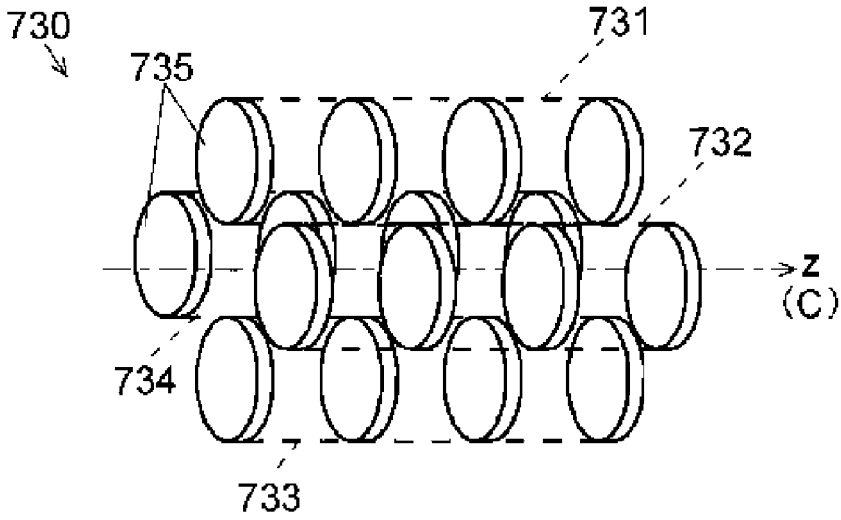
Fig. 17 Prior Art
FIG. 17 is a schematic configuration diagram of a conventional virtual quadrupole rod type ion transport optical system.

FIG. 14 illustrates the configuration of the Q-array 50 provided in the collision cell 61. The Q-array 50 provided between the injection side aperture 611 and the exit side aperture 612, both of which are bored at the collision cell 61, has two kinds of electrode plane plates' interval of d1 and d2 and two kinds of thickness of t1 and t2 in one virtual rod electrode. In the anterior half portion 50A, the electrode plane plates' thickness is t1 and the electrodes' interval is d1. In the posterior half portion 50B, the electrode plane plates' thickness is t2 which is thicker than t1 and the electrodes' interval is d2 which is narrower than d2. Therefore, this Q-array 50 functions like a combination of the Q-array 30 illustrated in FIG. 4 and the Q-array 40 illustrated in FIG. 5: the multipole field components' action is stronger in the anterior half portion 50A, and the quadrupole field's action is stronger in the posterior half portion.

That is, in the anterior half portion 50A, precursor ions are collected with high ion acceptance, and product ions generated from these precursor ions are sent into the posterior half portion 50B with high transmission. In the posterior half portion 50B, the product ions are converged in the vicinity of the ion optical axis C to effectively pass through the exit side aperture 612, and sent into the second-stage quadrupole mass filter 63. This can increase the signal intensity of product ions for example.

As previously described, the virtual multipole ion transport optical system, which characterizes the mass spectrometer according to the present invention, can appropriately adjust high-order multipole field components at the ion entrance side and ion exit side for example in one ion optical system. Therefore, it is possible to send ions into an ion optical element in the subsequent stage with higher efficiency compared to conventional multipole ion transport optical systems or virtual multipole ion transport optical systems.

It should be noted that each of the aforementioned embodiments is merely an example of the present invention, and it is evident that any change, modification, or addition appropriately made within the spirit of the preset invention is also covered by the claims of the present patent application.

The invention claimed is:

1. A mass spectrometer including a virtual multipole rod type ion transport optical system in which 2N (where N is an integer equal to or more than two) virtual rod electrodes are placed in such a manner as to surround an ion optical axis, each of the virtual rod electrodes being composed of M (where M is an integer equal to or more than two) electrode plane plates separated from each other in the ion optical axis direction, wherein:

the M electrode plane plates composing one virtual rod electrode are arranged in such a manner that the length of the interval between electrode plane plates adjacent in the ion optical axis varies along said ion optical axis.

2. A mass spectrometer including a virtual multipole rod type ion transport optical system in which 2N (where N is an integer equal to or more than two) virtual rod electrodes are placed in such a manner as to surround an ion optical axis, each of the virtual rod electrodes being composed of M (where M is an integer equal to or more than two) electrode plane plates separated from each other in the ion optical axis direction, wherein:

the M electrode plane plates composing one virtual rod electrode include an electrode plane plate having a different plate thickness in the ion optical axis direction than another electrode plane plate of the virtual rod electrode.

3. The mass spectrometer according to claim 1, wherein, in the virtual multipole rod type ion transport optical system, an interval between adjacent electrode plane plates is relatively large at an ion injection side and an interval between adjacent electrode plane plates is relatively small at an ion exit side.

4. The mass spectrometer according to claim 2, wherein, in the virtual multipole rod type ion transport optical system, a relatively thin electrode plane plate is placed at an ion injection side and a relatively thick electrode plane plate is placed at an ion exit side.

5. A mass spectrometer including a virtual multipole rod type ion transport optical system in which 2N (where N is an integer equal to or more than two) virtual rod electrodes are placed in such a manner as to surround an ion optical axis, each of the virtual rod electrodes being composed of M (where M is an integer equal to or more than two) electrode plane plates separated from each other in the ion optical axis direction, wherein:

the M electrode plane plates composing one virtual rod electrode include a plurality of kinds of plane plates having a different shape of an outer edge facing the ion optical axis direction, wherein, in the virtual multipole rod type ion transport optical system, a relatively narrow electrode plane plate is placed at an ion injection side and a relatively wide electrode plane plate is placed at an ion exit side.

6. A mass spectrometer including a virtual multipole rod type ion transport optical system in which 2N (where N is an integer equal to or more than two) virtual rod electrodes are placed in such a manner as to surround an ion optical axis, each of the virtual rod electrodes being composed of M (where M is an integer equal to or more than two) electrode plane plates separated from each other in the ion optical axis direction, wherein:

the M electrode plane plates composing one virtual rod electrode include a plurality of kinds of plane plates having a different shape of an outer edge facing the ion optical axis direction, wherein, in the virtual multipole rod type ion transport optical system, a shape of the outer edge facing the ion optical axis is an arc, an electrode plane plate with an arc whose radius of curvature is relatively small is placed at an ion injection side and an electrode plane plate with an arc whose radius of curvature is relatively large is placed at an ion exit side.

7. The mass spectrometer according to claim 1, wherein the virtual multipole rod type ion transport optical system is provided as a pre-filter in a previous stage of a main body of a quadrupole mass filter.

8. The mass spectrometer according to claim 1, wherein the virtual multipole rod type ion transport optical system is provided in a collision cell supplied with a gas for collision induced dissociation of ions.

9. The mass spectrometer according to claim 1, wherein the N is two.

10. The mass spectrometer according to claim 1, wherein each of the M electrode plane plates separated from each other in the ion optical axis direction is composed of a tongue-shaped body projecting in the ion optical axis direction from one columnar body.

11. The mass spectrometer according to claim 1, wherein, in the virtual multipole rod type ion transport optical system, an interval between adjacent electrode plane plates is relatively small at an ion injection section and at an ion exit section and an interval between adjacent electrode plane plates is relatively large at an intermediate section.

12. The mass spectrometer according to claim 1, wherein, in the virtual multipole rod type ion transport optical system, a relatively thick electrode plane plate is placed at an ion injection section and at an ion exit section, and a relatively thin electrode plane plate is placed at an intermediate section.

13. The mass spectrometer according to claim 2, wherein the virtual multipole rod type ion transport optical system is provided as a pre-filter in a previous stage of a main body of a quadrupole mass filter.

14. The mass spectrometer according to claim 5, wherein the virtual multipole rod type ion transport optical system is provided as a pre-filter in a previous stage of a main body of a quadrupole mass filter.

15. The mass spectrometer according to claim 2, wherein the virtual multipole rod type ion transport optical system is provided in a collision cell supplied with a gas for collision induced dissociation of ions.

16. The mass spectrometer according to claim 5, wherein the virtual multipole rod type ion transport optical system is provided in a collision cell supplied with a gas for collision induced dissociation of ions.

17. The mass spectrometer according to claim 2, wherein the N is two.

18. The mass spectrometer according to claim 5, wherein the N is two.

19. The mass spectrometer according to claim 2, wherein each of the M electrode plane plates separated from each other in the ion optical axis direction is composed of a tongue-shaped body projecting in the ion optical axis direction from one columnar body.

20. The mass spectrometer according to claim 5, wherein each of the M electrode plane plates separated from each other in the ion optical axis direction is composed of a tongue-shaped body projecting in the ion optical axis direction from one columnar body.

21. The mass spectrometer according to claim 6, wherein the virtual multipole rod type ion transport optical system is provided as a pre-filter in a previous stage of a main body of a quadrupole mass filter.

22. The mass spectrometer according to claim 6, wherein the virtual multipole rod type ion transport optical system is provided in a collision cell supplied with a gas for collision induced dissociation of ions.

23. The mass spectrometer according to claim 6, wherein the N is two.

24. The mass spectrometer according to claim 6, wherein each of the M electrode plane plates separated from each other in the ion optical axis direction is composed of a tongue-shaped body projecting in the ion optical axis direction from one columnar body.

* * * * *